United States Patent [19]

Clifton

[11] 4,271,540

[45] Jun. 9, 1981

[54] SEWAGE SYSTEM WITH COMMINUTOR

[76] Inventor: Ronald M. Clifton, Rte. 2, Box 2030, Porter, Tex. 77365

[21] Appl. No.: 33,444

[22] Filed: Apr. 26, 1979

[51] Int. Cl.[3] ..... E03D 9/10; B02C 13/00

[52] U.S. Cl. ..... 4/319; 4/DIG. 4; 210/174; 241/46.11

[58] Field of Search ..... 4/300, 319, 320, DIG. 4, 4/DIG. 19, DIG. 14, 278, 431–433; 241/46.11, 46.17; 210/173, 174

[56] References Cited

U.S. PATENT DOCUMENTS

| | | | |
|---|---|---|---|
| 1,434,066 | 10/1922 | Rodgers | 4/DIG. 4 |
| 1,459,622 | 6/1923 | Gallucci | 4/DIG. 4 |
| 1,996,325 | 4/1935 | Cox | 4/320 |
| 2,414,964 | 1/1947 | McPherson | 4/319 |
| 2,724,837 | 11/1955 | McPherson | 4/390 |
| 2,779,948 | 2/1957 | Houle | 4/319 |
| 2,798,228 | 7/1957 | Boester | 4/320 |
| 3,361,369 | 1/1968 | Ruble | 241/46.17 |
| 3,439,361 | 4/1969 | Moore | 4/319 |
| 3,502,274 | 3/1970 | Neidl | 241/46.11 |
| 3,620,460 | 11/1971 | Hankes | 241/46.11 |
| 3,727,241 | 4/1973 | Drouhard et al. | 4/319 |
| 3,733,617 | 5/1973 | Bennett | 4/320 |
| 3,755,827 | 9/1973 | Riedel et al. | 4/320 X |
| 3,945,576 | 3/1976 | Kohnmann | 241/46.17 |
| 4,052,758 | 10/1977 | Arena | 4/DIG. 19 |

FOREIGN PATENT DOCUMENTS

| | | | |
|---|---|---|---|
| 1349257 | 9/1963 | France | 4/432 |

*Primary Examiner*—Stuart S. Levy
*Attorney, Agent, or Firm*—Neal J. Mosely

[57] ABSTRACT

A sewage system for handling human waste provides for comminution of excrement and other material processed therein. The system is primarily of use in a system wherein the toilets empty into sewage pipe leading to a septic field and avoids the need for frequent reaming of the sewage pipe. In this system, an electrically powered grinder of a size small enough to fit within the sewer pipe is fitted in said pipe at the outlet from the toilet. The grinder is supported in the sewer pipe and sealed in place so that all of the effluent from the toilet passes therethrough. The housing of the grinder has a supporting flange that supports it by being sealed between the bottom flange of the toilet and the sealing gasket on the floor.

8 Claims, 2 Drawing Figures

SEWAGE SYSTEM WITH COMMINUTOR

BACKGROUND OF THE INVENTION

1. Field of the Invention

This invention relates to new and useful improvements in waste disposal systems and more particularly to sewage systems provided with means for comminution of excrement and other material processed therein.

2. Brief Description of the Prior Art

In sewage systems, handling disposal of human waste, and other materials to a sanitary sewer to a septic tank, there has been a need for providing means to prevent frequent plugging of the sewage pipe. In the past, sewage systems discharging to septic tanks have often required frequent reaming to keep the sewage lines operative. In the past, some specialized sewage disposal systems have been designed, particularly for public carriers, such as trains, which have included mixing or comminuting devices to keep the effluent lines open. These systems have required specially designed equipment and have required special designed toilets for using such equipment. As a result, equipment of this type has not been capable of general application. Representative United States patents illustrating special equipment of this type are set forth below.

Cox, U.S. Pat. No. 1,996,325, discloses a sewage disposal system for public carriers, such as railway trains, busses, and airplanes, in which a specially designed toilet is provided with an electrically driven beater or agitator.

McPherson, U.S. Pat. No. 2,414,964 discloses a specially designed toilet having a grinding or comminuting or mixing device formed integrally therewith.

McPherson, U.S. Pat. No. 2,724,837 discloses a self-contained sewage system applicable to vehicles such as aircraft, railway trains and the like, having a storage tank positioned immediately under a toilet and a comminuting or mixing device positioned in the tank and extending into the outlet from the toilet.

Houle, U.S. Pat. No. 2,779,948 discloses a flush-type toilet bowl having mechanical means for comminuting solid waste matter. The comminuting means is formed integrally with the toilet and comprises a unitary structure.

Boester, U.S. Pat. No. 2,798,228 discloses a sewage disposal system having a grinding or comminuting device secured on and a part of a toilet. A toilet is not provided with a water seal trap and the comminuting device is provided as a special piece of equipment connected independently of the sewage line and having an affluent line leading to the sewage line. In addition, the motor for the comminuting device drives a pump for recirculating fluid from a storage tank, which may be a septic tank, to a toilet bowl for flushing. This apparatus requires specially designed equipment and is not applicable to toilets and sewage systems already installed.

Drouhard, U.S. Pat. No. 3,727,241 discloses a specially designed sewage system in which a toilet has a comminuting or grinding or mixing device built into the base thereof.

Arena, U.S. Pat. No. 4,052,758 discloses a human waste disposal system having a comminuting or mixing device built into the base of a specially designed toilet and arranged to be operated on a very small flow of flushing liquid.

The several patents described above all require specially designed toilets and are not capable of installation in existing toilets or in existing sewage disposal systems.

SUMMARY OF THE INVENTION

It is one object of this invention to provide a improved human waste disposal system or sewage system having means to prevent plugging or stopping up of the sewage line.

Another object of this invention is to provide an improved sewage system having means for comminuting effluent from toilets.

Another object of this invention is to provide an improved sewage system having comminuting means removably positioned in the sewage line from the outlet of a toilet bowl.

Still another object of this invention is to provide an improved sewage system having grinding or comminuting means removably positioned in the sewage line and sealed between the sewage line and the base of a toilet supplying affluent to said line.

Still another object of this invention is to provide a sewage system having a grinder or comminutor removably positioned in the sewage line leading from a toilet and including means in said grinder or comminutor for preventing plugging or stopping up of the outlet openings therefrom.

Other objects of this invention will become apparent from time to time throughout the specification and the claims as hereinafter related.

A sewage system for handling human waste, and achieving the aforementioned objects provides for comminution of excrement and other materials processed therein. The system is primarily of use in a system wherein the toilets empty into the sewage pipe leading to a septic tank or field, and avoids the need for frequent reaming of the sewage pipe. In this system, an electrically powered grinder of size small enough to fit within the already installed sewer pipe, is fitted in said pipe at the outlet from the toilet. The grinder is supported in the sewer pipe and sealed in place so that all of the effluent from the toilet passes therethrough. The housing of the grinder has a supporting flange that supports it by being sealed between the bottom flange of the toilet and the sealing gasket on the floor. The grinder includes means not only for grinding but also for dislodging material from the outlet openings in the grinder's housing. This system has the advantage that the grinder or comminutor used is removably positioned in already installed sewer pipe and is useable with standard toilet designs and does not require specially designed equipment.

DESCRIPTION OF THE PREFERRED EMBODIMENT

Figure 1:
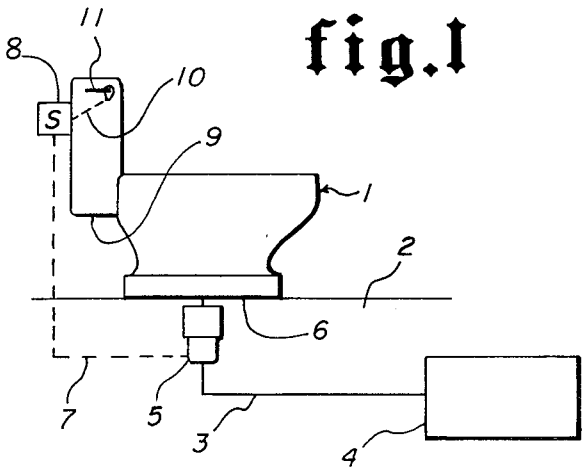
FIG. 1 is a schematic view of a sewage system comprising a preferred embodiment of this invention.

Referring now to FIG. 1 of the drawings, there is shown schematically a sewage system which embodies a preferred form of the subject invention. A toilet 1 is shown positioned on a floor 2 and provided with a sewage line 3 leading to an external septic tank 4. An electrically powered grinder or comminutor 5 is positioned in sewage line 3 at the outlet 6 from toilet 1. Grinder or comminutor 5 is removably supported in sewage line 3 and sealed between the outlet end 6 of toilet 1 and inlet to sewage line 3 as will be shown and described in more detail in FIG. 2. Grinder or comminutor 5 is provided with electrical leads 7 leading to switch 8 shown supported on toilet tank 9. Switch 8 may be an independently actuated switch or may be coupled as indicated in dotted line 10 to the operation of handle 11 which operates the flushing mechanism of toilet 1. Also, if desired, switch 8 may be arranged to operate in response to flow of flushing liquid in toilet 1.

In the introduction to this specification, it was pointed out that the use of grinding and comminuting mechanisms is known in specially designed toilets and using specially designed equipment. Such grinding mechanisms are not applicable to equipment already installed, and are not useful in connection with toilets of standard or conventional design.

Figure 2:
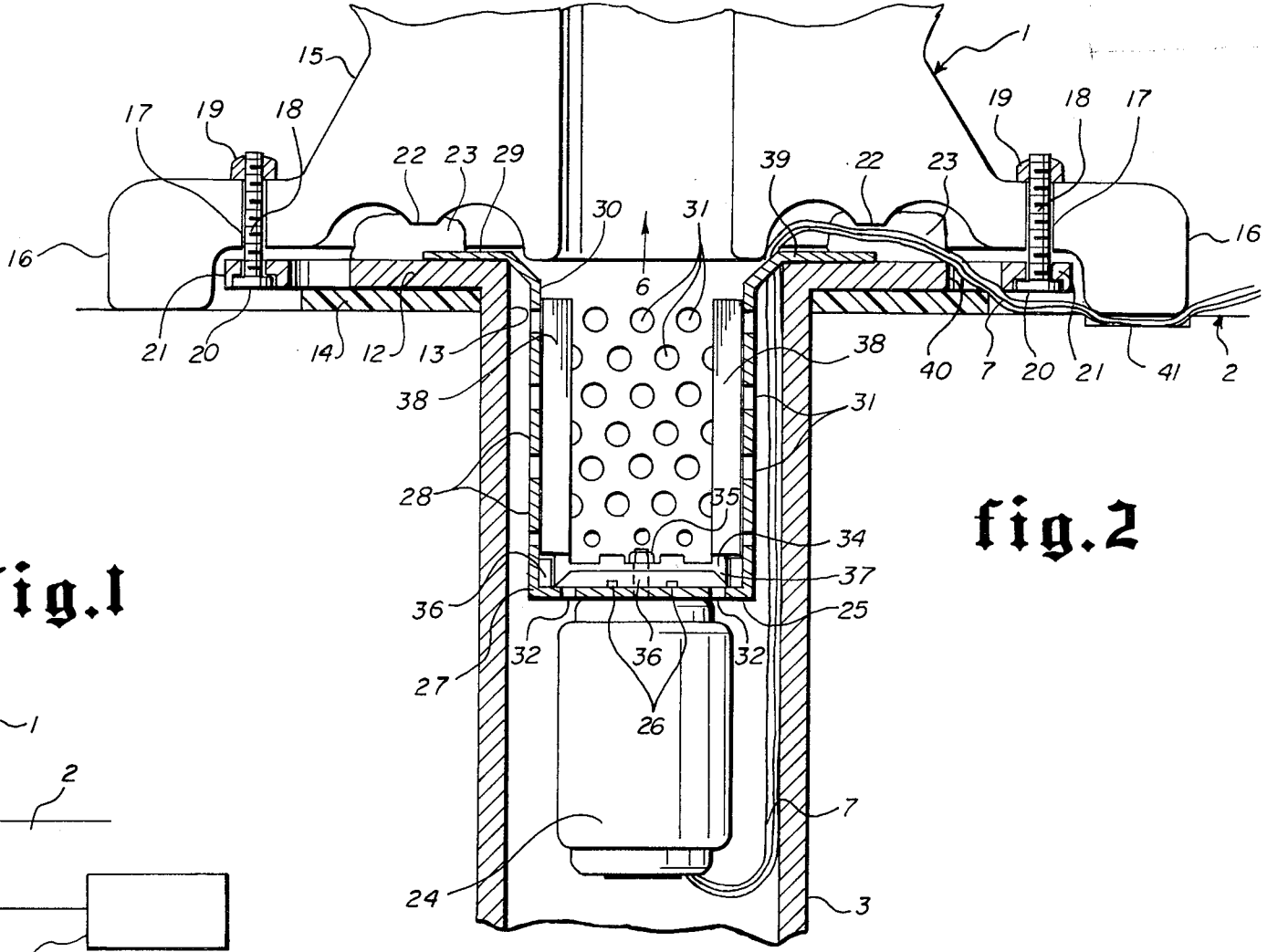
FIG. 2 is a detailed sectional view of the outlet and of a toilet and inlet end of a sewer pipe, illustrating a preferred embodiment of the invention.

In this embodiment of the invention, as indicated schematically in FIG. 1 and as illustrated in more detail in FIG. 2, the comminuting or grinding mechanism 5 is of a size to fit entirely within a standard sewage pipe and is removably positioned therein and sealed in place at the inlet end of the sewage pipe and adjacent the outlet from the toilet.

In the detail view shown in FIG. 2, it is seen that toilet 1 is of standard or conventional design and is secured to floor 2 adjacent the upper end of sewer pipe 3 in the standard or conventional manner. Sewer pipe 3 has an outwardly extending flange 12 at its upper or inlet end portion 13. Flange 12 overlies a spacing or supporting plate 14 positioned between the base of the toilet and floor 2. The base portion 15 of toilet 1 includes outwardly extending flange 16 having appertures 17 through which extend bolts 18 secured in place by nuts 19. Bolts 18 have head portions 20 which are secured in slots 21 in flange 12. The base portion 15 of toilet 1 has a downwardly extending flange 22 which fits in sealing engagement with gasket 23 which seals the base of the toilet against leakage.

Comminutor or grinder 5 comprises a submergable electric motor 24 which is secured on housing 25 by nuts 26. Motor 24 and housing 25 are small and compact in size and fit inside sewer pipe 3 with some clearance on either side.

Housing 25 has a bottom end wall 27, cylindrical side wall 28, and peripherally extending flange 29 at its open upper end 30. Flange 29 is supported on sewer pipe flange 12 and is sealed against leakage by gasket 23. The open upper end 30 of housing 25 is open to the bottom or outlet 6 of toilet 1. The cylindrical side wall 28 and end wall 27 of housing 25 are provided with a plurality of apertures 31 and 32, respectively.

Comminutor or grinder 5 includes motor shaft 33 extending through end wall 27 of housing 25 and having a rotary grinding ring 34 secured thereon by nut 35. Rotary grinding ring 34 rotates within and has a relatively small clearance relative to stationary grinding ring 36 positioned adjacent end wall 27 of housing 25. Rotary grinding ring 34 has a plurality of abutments 37 positioned for movement relative to grinding ring 36 for comminuting or grinding effluent material which thereafter passes out through passages 32 in end wall 27 of housing 25.

Rotary grinding ring 34 is also provided with a plurality of upwardly extending members 38 which are integral therewith and are rotated along the inner surface of cylindrical side wall 28. Members 38 provide for some comminution of waste material between the edges of members 38 and apertures 31 in side wall 28. In addition, members 38 function to continuously sweep the inner surface of cylindrical side wall 28 to keep material from becoming lodged in apertures 31. Members 38 and abutments 37 and the base portion of rotary grinding ring 34 are all formed of hardened steel and are capable of comminuting or grinding relatively hard, nonmetallic materials. Grinding ring 36 is likewise formed of hardened steel and is stationary in the lower end of housing 25.

The electric leads 7 from motor 24 pass out through a slot or aperture 39 in flange 29 and pass under or through gasket 23 into aperture 40. From aperture 40, leads 7 pass under toilet base flange 16 through slot or groove 41 in the floor. As noted in FIG. 1, electric leads 7 are connected to a source of electric power and are controlled by switch 8. The function of switch 8 is to permit motor 24 to be energized whenever toilet 1 is operated. Switch 8 may be a manually operated switch or may be a switch which is operated by or in association with a toilet flushing handle 11 or which may be a flow responsive switch which operates in response to flow of flushing liquid.

OPERATION

The operation of this apparatus should be apparent from the foregoing description, but will be explained further for purposes of clarity. The arrangement of toilet 1, sewer pipe 3 and septic tank 4 is a standard or conventional sewage system. The sewer pipe 3 and toilet 1 are of standard or conventional design and do not require any special equipment.

As described above, comminutor or grinder 5 is removably positioned in sewage pipe 3 and, thus, can be used with existing toilet installations. When comminutor or grinder 5 is assembled, as illustrated and described, all of the effluent from toilet 1 passes through its lower or discharge opening 6 into the open upper end 30 of housing 25. Switch 8 is actuated to energize motor 24 and cause rotary grinding disc 34 and the grinding abutments 37 and other grinding elements 38 to be rotated at a high speed.

The flushing liquid and other liquid effluent from toilet 1 is free to pass out through apertures 31 and 32 into sewage pipe 3. Rotary grinding disc 34 and its grinding elements function to comminute solid waste, including human waste, toilet paper, etc., by action of abutments 37 against stationary grinding ring 36 and by action of grinding elements 38 against the inner surface of cylindrical side wall 28. Elements 38 of grinding member 34 also function to sweep the inner surface of cylindrical side wall 28 and keep the same free of waste material and also to dislodge waste material from apertures 31.

This apparatus is easily installed in existing toilet installations and does not require any change in the basic original equipment. The use of this apparatus in a sewage system, as described, is effective to prevent plugging of the sewer line whether the line leads to a septic tank or a conventional sanitary sewer.

I claim:

1. In combination with a sewage system comprising
a sewage pipe extending downwardly through a floor for connection to a sewer or septic tank,
said sewage pipe including an outwardly extending flange at the floor, a toilet bowl supported on said floor over said sewage pipe and having a supporting base fitting over said outwardly extending flange, and a sealing gasket providing a peripheral seal between said supporting base of said toilet and said outwardly extending sewage pipe flange;

an electrically powered grinding apparatus for comminuting the effluent from said toilet, including a rotary grinder and submersible electric motor therefor, said grinding apparatus, including said grinder and said submersible electric motor, being positioned inside said sewage pipe and removably supported therein at said outwardly extending sewage pipe flange, said grinder includes a hollow housing having a plurality of openings for discharge of comminuted effluent, said housing having a peripheral flange positioned between said outwardly extending sewage pipe flange and the supporting base of said toilet and supports said apparatus in said sewage pipe to receive all the effluent from said toilet.

2. A system according to claim 1 in which said grinding apparatus is sealed between said outwardly extending flange and the supporting base of said toilet bowl.

3. A system according to claim 2 in which said flange on said grinding apparatus housing is positioned in sealing relation with said sealing gasket.

4. A system according to claim 1 in which said grinding apparatus includes switch means for actuating the same independently of the operation of said toilet.

5. A system according to claim 1 in which said grinding apparatus includes switch means for actuating the same in response to the operation of said toilet.

6. A system according to claim 1 in which said grinder housing peripheral flange is positioned in sealing relation with said sealing gasket between said outwardly extending sewage pipe flange and the supporting base of said toilet to support said apparatus in said sewage pipe to receive all of the effluent from said toilet, and includes a sealed electric motor secured to and supported below said grinder in said sewage pipe and having externally extending wiring positioned adjacent to and extending outwardly past said sealing gasket.

7. A system according to claim 6 which said grinding apparatus includes a stationary grinding member and a rotary grinding member cooperable therewith to comminute sewage effluent from said toilet, and rotary means to dislodge sewage effluent from the outlet of the grinding apparatus.

8. A system according to claim 7 in which said stationary grinding member and said rotary grinding member being positioned in said housing, and said rotary grinding member having a portion movable along the surface of said openings to comminute sewage effluent and to sweep said openings clear of effluent material tending to become lodged therein.

* * * * *